United States Patent [19]

Kobayashi et al.

[11] Patent Number: 4,659,397

[45] Date of Patent: Apr. 21, 1987

[54] MANUFACTURING PROCESS FOR PLATE OR FORGING OF FERRITE-AUSTENITE TWO-PHASE STAINLESS STEEL

[75] Inventors: Mineo Kobayashi; Takeshi Yoshida; Masahiro Aoki, all of Jyouetsu; Masao Okubo; Masaaki Nagayama, both of Niihama, all of Japan

[73] Assignees: Nippon Stainless Steel Co. Ltd.; Sumitomo Chemical Co., Ltd., both of Osaka, Japan

[21] Appl. No.: 646,896

[22] Filed: Aug. 31, 1984

[30] Foreign Application Priority Data

Sep. 1, 1983 [JP] Japan ..... 58-161087

[51] Int. Cl.[4] ..... C21D 7/13

[52] U.S. Cl. ..... 148/12 E; 148/12 EA; 148/12.1

[58] Field of Search ..... 148/12 E, 37, 38, 12 EA, 148/12 C, 12.1; 72/364, 700

[56] References Cited

U.S. PATENT DOCUMENTS 4,272,305 6/1981 Weingerl et al. ..... 148/12 E

FOREIGN PATENT DOCUMENTS 0134246 2/1979 Fed. Rep. of Germany ..... 148/38
5644757 4/1981 Japan ..... 148/12 E
56-142855 11/1981 Japan ..... 148/37
59-35620 2/1984 Japan ..... 148/12 E

OTHER PUBLICATIONS

Allen, K. Dell, "Plastic Deformation of Metals, Metallurgy Theory and Practice, pp. 507-516.

*Primary Examiner*—Dewayne Rutledge
*Assistant Examiner*—Deborah Yee
*Attorney, Agent, or Firm*—David G. Rosenbaum

[57] ABSTRACT

This invention relates to a manufacturing process for plate or forging (bar, stamp work or the like) of ferrite-austenite two-phase stainless steel, containing C at 0.03% or below, Si at 2.0% or below, Mn at 2.0% or below, Cr at 25 to 35%, Ni at 6 to 15%, N at 0.35% or below, and Fe and inevitable impurity for the remainder with or without adding B at 0.001 to 0.030% with the following nickel balance value specified at −3 to −9 and comprising an average crystal grain size at 0.015 mm or below from heating an ingot of the above mentioned ferrite-austenite two-phase stainless steel at 1,200° C. or below and keeping a forging ratio by hot working at 5 or over.

Ni balance value = Ni % + 0.5 Mn % + 30 × (C + N) % − 1.1(Cr % + 1.5 Si %) + 8.2

12 Claims, 3 Drawing Figures

MANUFACTURING PROCESS FOR PLATE OR FORGING OF FERRITE-AUSTENITE TWO-PHASE STAINLESS STEEL

BACKGROUND OF THE INVENTION

1. Field of the Invention

This invention relates to a manufacturing process for plate or forging (bar, stamp work or the like) of ferrite-austenite two-phase stainless steel and particularly of ferrite-austenite two-phase stainless steel superior in resistance to nitric acid.

2. Description of the Prior Art

In a nitric acid environment, a stainless steel having a higher content of Cr is strong in resistance thereto accordingly, and an intergranular corrosiveness is extremely severe according to the density of nitric acid, therefore an extremely-low carbon type and Nb-stabilized high-chrome austenite stainless steel, 310 LC (low carbon—25% Cr—20% Ni steel), 310 LCNb (low carbon—25% Cr—20% Ni—0.2% Nb steel) or the like, for example, is employed hitherto. However, in the case of such austenite stainless steel having a higher content of Ni, since a solid solubility limit of carbon (C) is small, a chrome carbide deposits preferentially onto a crystal grain boundary to deteriorate intergranular corrosion resistance under the effect of heating at 500° to 900° C. or welding heat, and a solidification cracking sensitivity is high at the time of welding, thus losing a reliability on the weld zone. On the other hand ferrite-austenite two-phase stainless steel having a high Cr content is susceptible, due to the heat generated by welding, to selective corrosion between the structures. Such corrosion tendency is conspicuous particularly in a nitric acid environment, and thus a conventional two-phase stainless steel has two properties adversely impacting on its ability to work as a nitric acid resistant material having a welded structure.

As the result of having studied on influences of structure and percentages of elemental fractions on nitric acid resistance in stainless steel, the inventors contrived a high-chrome two-phase stainless steel effective to alleviate the above-described defects of austenite stainless steel and two-phase stainless steel, and provide superior in nitric acid resistance and weldability, and cheap in cost as well. (Japanese Patent Application No. 130442/1981 (Japanese Patent Laid-Open No. 3106/1983)). This inventive type of steel has a higher Cr and Ni content as compared with a conventional ferrite-austenite two-phase stainless steel having Cr of 23 to 25% and Ni of 4 to 6% generally, and a specific Ni balance value at the same time. Moreover, a structure has been found which is superior in nitric acid resistance to the above-mentioned materials of 310 LC and 310 LCNb even though an expensive Ni component is present in lesser amounts. Further, the nitric acid resistance is improved by adding B at 0.001 to 0.03% thereto, which is enhanced more by decreasing P to 0.010% or below and S to 0.005% or below which are contained inevitably as impurities, and it has the following compositions:

(1) That for which the composition is: C being 0.03% by weight or below, Si being 2.0% or below, Mn being 2.0% or below, P being 0.040% or below, S being 0.030% or below, Cr being 25 to 35%, Ni being 6 to 15%, N being 0.35% or below, Fe and inevitable impurity for the remainder, and also the following expression $$-13 < \text{Ni eq} - 1.1 \times \text{Cr eq} + 8.2 < -9$$

is satisfied.

(2) That for which 0.001 to 0.03% B is added to the above mentioned steel.

(3) That for which P and S are decreased independently or simultaneously to 0.010% or below and to 0.005% or below respectively in the above mentioned steels (1) and (2).

The inventive steel has superior resistance to nitric acid, this property is the result of the elemental composition and the fine grain structure of ferrite and austenite peculiar to two-phase stainless steel. That is, the superior resistance to nitric acid is due to a superior intergranular corrosion resistance, and it is generally known that the intergranular corrosion resistance depends on a crystal grain size, and the smaller the crystal grain size is, the better the resistance becomes. Thus the superior intergranular corrosion resistance of the steel is intrinsically related to the fine structure which is a feature of the two-phase stainless steel. Originally, the crystal grain size of the two-phase stainless steel is influenced largely by its manufacturing history, and the larger a forging ratio is, the smaller the grain size becomes. However, when it is heated at high temperatures of 1,250° C. and over for hot working, the structure comes near to a single phase structure of ferrite with the resulting excessive coarsening of the crystal grain.

SUMMARY OF THE INVENTION

Now, in consideration of such characteristic of the two-phase stainless steel, a principal object of this invention is to manufacture a plate or forging of ferrite-austenite two-phase stainless steel superior particularly in resistance to nitric acid.

That is, the invention is to improve nitric acid resistance and particularly intergranular corrosion resistance by controlling the crystal grain size of a product to 0.015 mm or below through hot working of a two-phase stainless steel having the above-mentioned composition.

The above-mentioned object and features of this invention will be apparent from the following detailed description thereof taken with the accompanying drawings.

BRIEF DESCRIPTION OF THE DRAWINGS

In the accompanying drawings.

DETAILED DESCRIPTION OF PREFERRED EMBODIMENTS

Figure 1:
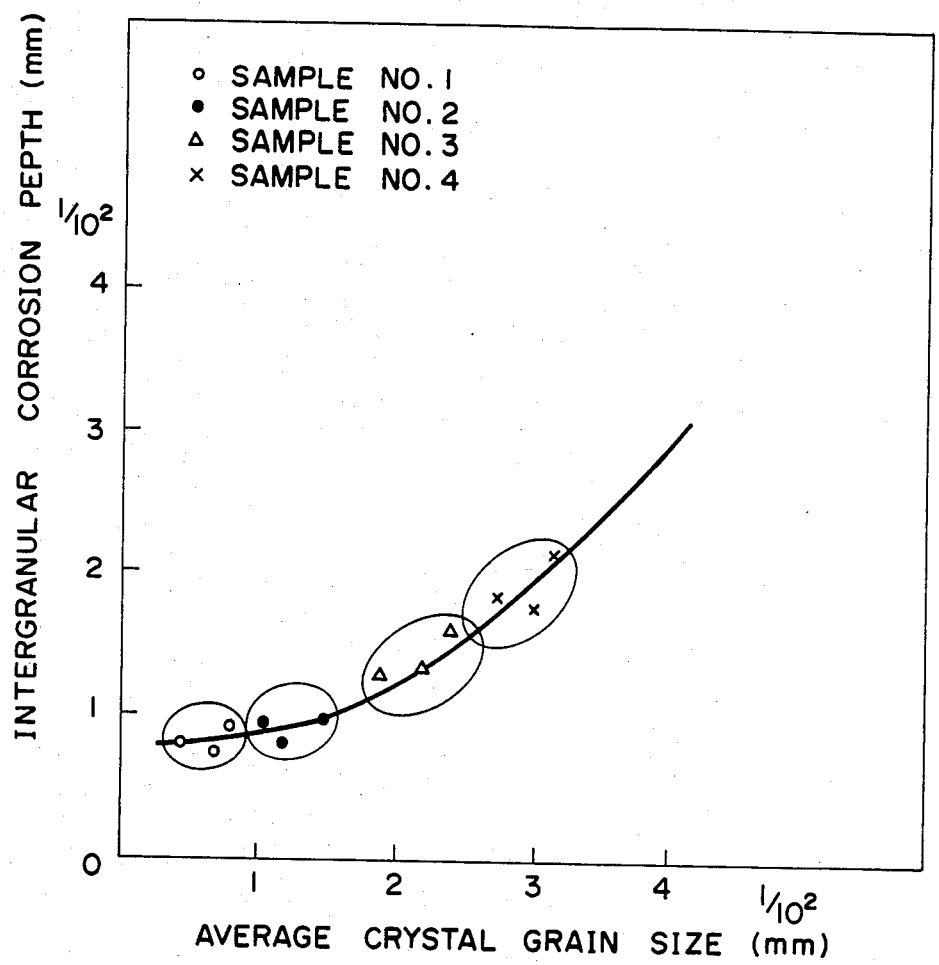
FIG. 1 is a relational drawing of a intergranular corrosion depth to an average crystal grain size of product plate and a manufacturing condition of product.

It has been found that a resistance to nitric acid and particularly a intergranular corrosion resistance can be improved by controlling the crystal grain size of a product to 0.015 mm or below.

The present invention improves intergranular nitric acid corrosion resistance by adjusting the heating temperature of the ingot to 1,200 degrees Centigrade or below in the hot working process and maintain a forging ratio during hot working of no less than about 5. The "forging ratio" refers to the overall working rate from the ingot, which is expressed by the ratio of the ingot sectional area to the product sectional area. It has been found that these conditions keep the average crystal grain size at no greater than about 0.015 mm in manufacturing a plate and a forging of the ferrite-austenite stainless steel, containing C at 0.03% or below, Si at 2.0% or below, Mn at 2.0% or below, Cr at 25 to 35%, Ni at 6 to 15%, N at 0.35% or below, Fe and inevitable impurity for the remainder with or without adding B at 0.001 to 0.030%, and having Ni balance value adjusted to −13 to −19.

This invention has found that a steel component containing higher elemental percentages of Cr and Ni, as compared with a conventional ferrite-austenite two-phase stainless steel having Cr of 23 to 25% and Ni of 4 to 6% generally, and having a specific Ni balance value at the same time, improves the nitric acid resistance so as to be superior in resistance to nitric acid to 310 LC and 310 LCNb even though an expensive Ni component is kept less, and further that enhances the resistance to nitric acid by adding B thereto as occasion demands, and furthermore by decreasing P to 0.010% or below and S to 0.005% or below which are contained inevitably as impurities. In manufacturing a plate and forging of the ferrite-austenite two-phase stainless steel having such a composition, a steel material superior remarkably in resistance to nitric acid is thus obtainable through regulating heating temperature and forging ratio in the process of hot working as described above, and the reason why the chemical composition is limited as above will be described first.

C: C is an effective element for formation of austenite, however, since it forms a carbide which acts to increase the intergranular corrosion sensitivity, it must be contained as small as possible. Still, in consideration of its being easy to manufacture, the upper limit will be 0.03%.

Si and Mn: Si and Mn are elements used as deoxidizers during the process of steel manufacture, and Si and Mn will have to be added normally at 2.0% or below to facilitate manufacture industrially, therefore each will be limited to 2.0% or below.

Cr: Cr is a ferrite forming element and is important not only for formation of a two-phase structure of austenite and ferrite but also for increasing corrosion resistance and particularly resistance to nitric acid, therefore it must be added at 25% or over for a satisfactory resistance to nitric acid. The resistance to nitric acid increases as a Cr content increases under proper structural balance, however, when it exceeds 35%, workability deteriorates and manufacture of steel material and fabrication of equipment become difficult to lose a practical applicability, therefore the upper limit will be specified at 35%.

Ni: Ni is an austenite forming element and is also important along with Cr for formation of a two-phase structure, and further it is a very important element for decreasing an active dissolution rate including general corrosion, therefore it must be added at 6% to 15% to obtain a preferable structural balance of ferrite-austenite correspondingly to the content of Cr which is a principal ferrite forming element.

N: N is a powerful austenite forming element like C and Ni, and is also effective for enhancement of a corrosion resistance such as pitting resistance, however, when N exceeds 0.35%, a blowhole may arise on ingot during the process for manufacturing steel and a hot workability will deteriorate, therefore it is limited to 0.35% or below.

In this invention, it is meaningless to specify these elements independently, and an excellent effect will be obtainable only under an optimum combination, therefore it is necessary to limit the range of each component so that the following expression will be satisfied, which is so found as will feature the invention in a sense.

$$-13 < \text{Ni balance value} < -9$$

where Ni balance value = Ni eq − 1.1 × Cr eq + 8.2, Ni eq = Ni% + 0.5 × Mn% + 30 × (C + N)%, Cr eq = Cr% + 1.5 × Si%.

Where Ni balance value falls below −13, there is an increased tendency for selective corrosion between structures, and under such condition not only the resistance to nitric acid cannot be improved even if the Cr content may be increased but also the Ni balance value is shifted in the direction more disadvantageous for corrosion resistance, thereby actually accelerating corrosion. On the other hand, if the Ni balance value is taken greater than −9, then not only is there incurred a disadvantage economically from increasing the addition rate of expensive Ni, but also a hot workability is prevented thereby and the corrosion resistance deteriorates consequently, therefore the Ni balance value is limited to −13 to −9.

B: The effect of improving resistance to nitric acid will be increased when B is added at 0.001% or over, however, workability and weldability will deteriorate when it exceeds 0.03%, therefore it is limited to 0.001 to 0.03%.

P and S: P and S which are impurity elements will be desirable, as they are kept less, however, as will be apparent from Japanese Industrial Standards and the like, P being 0.040% or below and S being 0.030% or below are normally permissible. However, when P is limited to 0.010% or below and S to 0.005% or below, the effect of improving resistance to nitric acid will be enhanced.

An effect equivalent to decreasing P and S was ensured from adding rare earth elements (REM) such as La, Ce and the like a small quantity or, for example, at about 0.02%.

Next, the reason why heating temperature and forging ratio are regulated as described hereinabove in a manufacturing process of this invention will be described.

Figure 2:
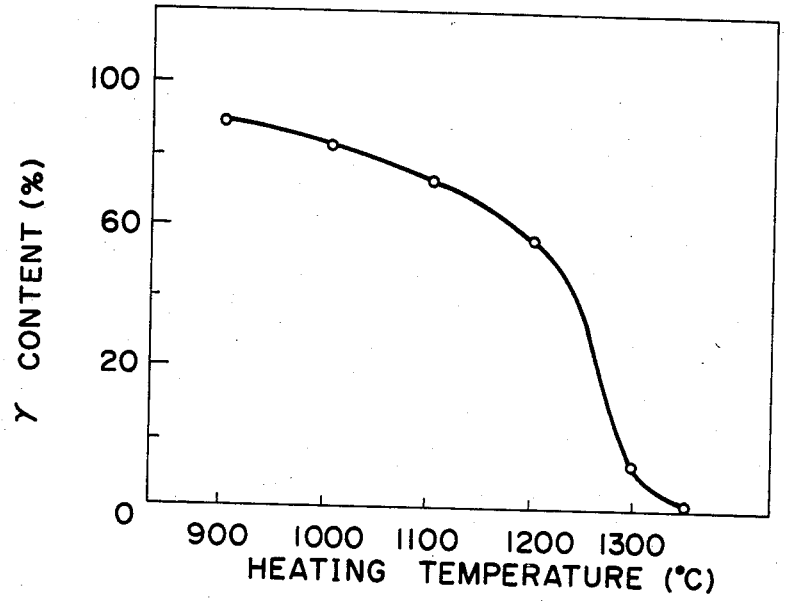
FIG. 2 is a relational drawing of a heating temperature to $\gamma$ (austenite phase) content.

In the case of two-phase stainless steel, the austenite phase decreases to nearly a single phase structure of ferrite as the heating temperature rises to 1,100° C. or over, which is a feature on the structure, and the above-mentioned steel is turned to a ferrite structure at about 1,350° C. In the ferrite-austenite two-phase structure, the growth of the ferrite crystal grain is suppressed by austenite crystal grain, however, when austenite decreases in volume, the effect of the suppression fades to turn the crystal grain coarse, and thus the austenite crystal grain becomes coarse at the same time. Further, as will be apparent from FIG. 2 representing a relation between heating temperature and $\gamma$ (austenite phase) content, the $\gamma$ content decreases abruptly at 1,200° C. or over, and coarsening increases sharply, therefore the upper limit is specified at 1,200° C. in the invention, however, in the case of two-phase stainless steel, cracking occurs during the hot work at 900° C. or below and thus the product yield deteriorates, therefore it is preferable to maintain a high heating temperature.

Then, in the hot working process, it is difficult to obtain a fine crystal size where there is a small amount of working, even if the heating temperature is maintained at less than about 1,200 degrees Centigrade, and where the hot working is less than about 10% it provides a driving force for the growth of crystal grains and thus to promote coarsening. Therefore the degree of working more than that will be necessary therefor, further where the degree of working is small, heating-working process must be repeated to obtain the required forging ratio, which may result in coarsening of the crystal grain, and on the other hand, it is difficult to obtain the forging ratio at 5 or over through single working, therefore the heating-working process must be repeated more than once, and in such case it is preferable that the degree of working per heating be kept at 50% or over. As will be apparent from the example described later, it is ensured by a manufacturing scale test that there may be a case where a desired average crystal grain size is not obtainable through the degree of working at 50% or below, 40% for example.

Figure 3:
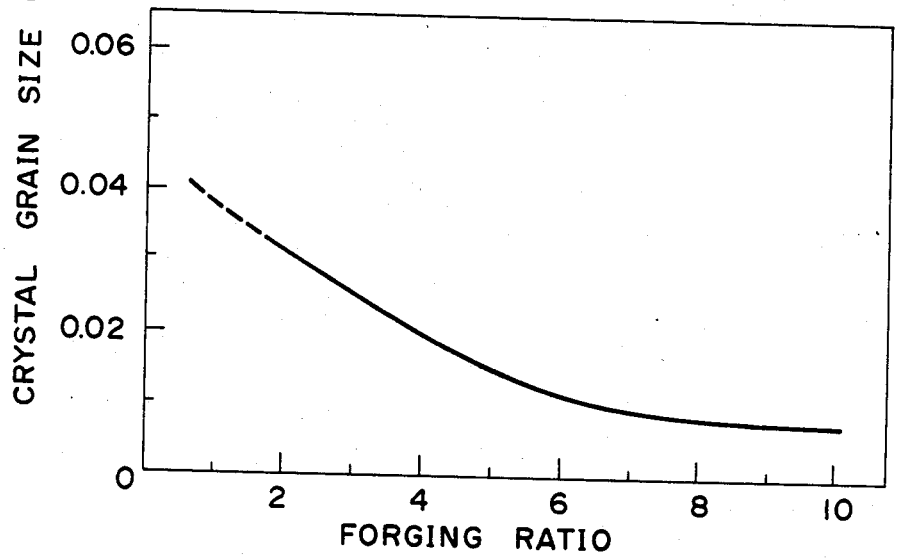
FIG. 3 is a relational drawing of a forging ratio to a crystal grain size.

Generally, the ingot structure is coarse as compared with forging material, and a crystal is made fine by repetition of working-recrystallization. However, it is found in this invention that the average crystal grain size at 0.015 mm or below as described above may minimize a intergranular corrosion depth to 0.010 mm or below, thus indicating a superior resistance to nitric acid (FIG. 1), and as will be apparent further from FIG. 3 representing a relation between forging ratio and crystal grain size, it is necessary to keep the forging ratio from ingot at 5 or over for obtaining the average crystal grain size at 0.015 mm or below.

As described, this invention relates to a manufacturing technique for plate and forging of ferrite-austenite two-phase stainless steel superior in resistance to nitric acid ensured by a specific component and manufacturing process.

An example of this invention will be described as follows:

EXAMPLE

Table 1 shows an example according to this invention, describing steels in this invention and comparative steels, SUS 329 J1 steel and extremely-low carbon 310 steel (310 ELC).

Under the working conditions given in Table 1, each 1-ton ingot of the above steels (2 kinds of steels of this invention and SUS 329 J1, 310 ELC) are heated twice by each forging ratio and hot rolled (sample No. 8 being heated three times), each is heated at 1,050° C. and water-cooled for solid solution annealing, and corrosion samples 3×20×30 mm (general-grinding #03) are then sampled to a 48-hour boiling test in 65% $HNO_3+Cr^{+6}$ 100 ppm solution 5 times, and then a intergranular corrosiveness in the nitric acid environment is evaluated from the intergranular corrosion depth.

Then, FIG. 1 illustrates a test result of sample Nos. 1 to 4, and as will be apparent from FIG. 1, the intergranular corrosion depth and the crystal grain size are correlated with each other, and the average grain sizing coming below 0.015 mm will minimize the intergranular corrosion depth to a superior resistance to nitric acid. Further, as shown in Table 1, corrosion resistance cannot be improved satisfactorily even if the forging ratio is 7 or over when the heating temperature works at 1,250° C. or over, therefore the working must be carried out at 1,200° C. or below, and an enhancement of the intergranular corrosion resistance is difficult even working at the heating temperature of 1,200° C. or below where the forging ratio is 3. Furthermore, a formation of the fine crystal grain is too insufficient to obtain a satisfactory corrosion resistance even the heating at 1,200° C. and the forging ratio at 5 where the degree of working at every times of heating comes below 40%. Then, the intergranular corrosion resistance cannot be improved any more from employing the working process according to this invention on SUS 329 J1 and 310 ELC.

Although the invention has been described in its preferred embodiment, it will be obvious to those skilled in the art that modification and variation is possible in light of the above description.

TABLE 1

| Sample | | Chemical component % | | | | | | | | | |
|---|---|---|---|---|---|---|---|---|---|---|---|
| No. | Classification | C | Si | Mn | P | S | Cr | Ni | N | Others | Ni-bal |
| 1 | Process of the invention | 0.011 | 0.52 | 0.58 | 0.028 | 0.008 | 26.75 | 8.02 | 0.10 | — | −10.44 |
| 2 | Process of the invention | " | " | " | " | " | " | " | " | | " |
| 3 | Process, comparative | " | " | " | " | " | " | " | " | | " |
| 4 | Process, comparative | " | " | " | " | " | " | " | " | | " |
| 5 | Process of the invention | 0.009 | 0.55 | 0.51 | 0.025 | 0.006 | 27.32 | 7.90 | 0.10 | B 0.0011 | −11.33 |
| 6 | Process of the invention | " | " | " | " | " | " | " | " | B 0.0011 | " |
| 7 | Process, comparative | " | " | " | " | " | " | " | " | B 0.0011 | " |
| 8 | Process, comparative | " | " | " | " | " | " | " | " | B 0.0011 | " |
| 9 | Process, comparative | 0.017 | 0.65 | 0.60 | 0.022 | 0.007 | 25.07 | 5.10 | 0.11 | Mo 1.80 | −8.84 |
| 10 | Process, comparative | 0.011 | 0.51 | 1.06 | 0.026 | 0.005 | 25.14 | 20.56 | — | | −13.22 |

TABLE 1-continued

| Sample No. | Classification | Working conditions: Heating temp. | Forging** ratio | Degree of working % | Average crystal grain size mm | Intergranular corrosion depth mm | Remarks |
|---|---|---|---|---|---|---|---|
| 1 | Process of the invention | 1200° C. | 6 | ≧60 | 0.012 | 0.009 | Steel of the invention |
| 2 | Process of the invention | " | 12 | ≧70 | 0.007 | 0.009 | " |
| 3 | Process, comparative | 1250° C. | 7 | ≧60 | 0.030 | 0.018 | " |
| 4 | Process, comparative | 1200° C. | 3 | ≧70 | 0.022 | 0.016 | " |
| 5 | Process of the invention | 1200° C. | 6 | ≧60 | 0.013 | 0.008 | " |
| 6 | Process of the invention | " | 11 | " | 0.008 | 0.010 | " |
| 7 | Process, comparative | 1250° C. | 8 | " | 0.027 | 0.019 | " |
| 8 | Process, comparative | 1200° C. | 5 | ≦40 (heated three times) | 0.020 | 0.015 | " |
| 9 | Process, comparative | 1200° C. | 7 | ≧60 | 0.012 | 0.018 | Comparative steel (SUS 329J1) |
| 10 | Process, comparative | 1200° C. | 7 | ≧70 | 0.080 | 0.100 | Comparative steel (SUS 310ELC) |

*Workability at every times of heating
**Ingot sectional area/finished product sectional area

What is claimed is:

1. A manufacturing process for plating and forging ferrite-austenite two-phase stainless steel to have superior nitric acid resistance, comprising the steps of:

providing ferrite-austenite two-phase stainless steel which contains not more than about 0.03% of C, not more than about 2.0% of Si, not more than about 2.0% of Mn, Cr. in the range of about 25 to 35%, Ni in the range of about 6 to 15%, N in the range of greater than about 0.03% to less than about 0.35%, and the balance Fe and inevitable impurities, and satisfies the following expression:

$$-13 < \text{Ni eq} - 1.1\text{Cr eq} + 8.2 < -9$$

where Ni eq=Ni%+0.5Mn%+30×(C+N)% and Cr eq≡Cr%+1.5Si%;

controlling the heating temperature of an ingot within the range of greater than about 900° C. to not more than about 1,200° C.;

hot working said ferrite-austenite two-phase stainless steel to a forging ratio of greater than about 5; and maintaining the average crystal grain size at not more than about 0.015 mm.

2. The manufacturing process of claim 1, further containing B in the range of about 0.001 to about 0.030%.

3. The manufacturing process of claim 1, wherein the contents of P and S which are inevitable impurities are controlled independently to not more than 0.010% for P and not more than 0.0005% for S.

4. The manufacturing process of claim 2, wherein the contents of P and S which are inevitable impurities are controlled independently to not more than 0.010% for P and not more than 0.005% for S.

5. The manufacturing process of claim 1, wherein the contents of P and S which are inevitable impurities are controlled simultaneously to not more than 0.010% for P and not more than 0.005% for S.

6. The manufacturing process of claim 2 wherein the contents of P and S which are inevitable impurities are controlled simultaneously to not more than 0.010% for P and not more than 0.005% for S.

7. The manufacturing process of claim 1, wherein the degree of working during heating is controlled to at least 50%, and a forging ratio is controlled to at least 5.

8. The manufacturing process of claim 2, wherein the degree of working during heating is controlled to at least 50%, and the forging ratio is controlled to at least 5.

9. The manufacturing process of claim 3, wherein the degree of working during of heating is controlled to at least 50%, and a forging ratio is controlled to at least 5.

10. The manufacturing process of claim 4, wherein the degree of working at all times of heating is controlled to at least 50%, and the forging ratio is controlled to at least 5.

11. The manufacturing process of claim 5, wherein the degree of working during of heating is controlled to at least 50%, and the forging ratio is controlled to at least 5.

12. The manufacturing process of claim 6, wherein the degree of working during of heating is controlled to at least 50%, and the forging ratio is controlled to at least 5.

* * * * *